United States Patent [19]

Miller

[11] Patent Number: 4,502,682

[45] **Date of Patent: * Mar. 5, 1985**

[54] FULL BODY WEIGHT TRACTION DEVICE

[75] Inventor: Jack V. Miller, Sierra Madre, Calif.

[73] Assignee: Gravity Guidance, Inc., Duarte, Calif.

[ * ] Notice: The portion of the term of this patent subsequent to Oct. 18, 2000 has been disclaimed.

[21] Appl. No.: 446,996

[22] Filed: Dec. 6, 1982

Related U.S. Application Data

[63] Continuation-in-part of Ser. No. 291,064, Aug. 7, 1981, Pat. No. 4,410,176.

[51] Int. Cl.[3] ..... A63B 17/00

[52] U.S. Cl. ..... 272/144; 272/145; 128/75

[58] Field of Search ..... 128/69–75, 128/24 R; 272/144, 33 R, 62, 109, 145; 297/326

[56] References Cited

U.S. PATENT DOCUMENTS

| | | | |
|---|---|---|---|
| 1,693,810 | 12/1928 | Daniels et al. | 128/70 |
| 3,081,085 | 3/1963 | Girolamo | 128/71 |
| 3,152,802 | 10/1964 | Heisler et al. | 272/134 X |
| 3,286,708 | 11/1966 | Gartner | 128/33 UX |
| 3,568,669 | 3/1971 | Stites | 128/71 |
| 3,716,231 | 2/1973 | Martin | 272/144 |
| 4,232,662 | 11/1980 | Barber | 272/144 |
| 4,410,176 | 10/1983 | Miller | 272/145 |

*Primary Examiner*—Robert A. Hafer
*Assistant Examiner*—Chris Coppens
*Attorney, Agent, or Firm*—Zarley, McKee, Thomte, Voorhees & Sease

[57] ABSTRACT

A full body weight traction device for rotating a human into inverted posture comprising generally U-shaped front and rear legs with the bases of the U-shapes resting on the floor and having upstanding sides terminating in pivot bearings, a shorter U-shaped trunion having upstanding sides also terminating in pivot bearings and having the base of its U attached to a tilt bed including a human torso supporting means and an elongated rail extending between the ankles of a user. The respective pivot bearings on each side of the front and rear legs and the trunion are pivotally connected by a pivot pin, permitting rotation of the tilt bed and folding of the legs for storage. The rail is provided with a hinge and lock which permits the rail to fold against the torso supporting means, whereby the tilt bed and legs fold into a configuration about the same length as the legs. The spacing of the sides of the rear leg is greater than the width of the tilt bed and the spacing of the sides of the front legs is less than the width of the tilt bed, whereby rotation of the tilt bed is stopped in the inverted position by the front leg sides. The footprint of the base of at least one of the U-shaped legs is increased by a stabilizer means.

9 Claims, 7 Drawing Figures

FULL BODY WEIGHT TRACTION DEVICE

This application is a continuation-in-part application of Ser. No. 291,064, filed Aug. 7, 1981, which issued as U.S. Pat. No. 4,410,176 Oct. 18, 1983.

BACKGROUND OF THE INVENTION

This invention relates to exercise devices for rotating a human user in oscillation and into inverted posture. This type of device is known and is described in U.S. Pat. No. 3,707,285 (Martin), U.S. Pat. No. 3,716,231 (Martin, U.S. Pat. No. 4,232,662 (Barber) and U.S. Pat. Nos. Des. 269,701 and 4,410,176. Ankle holding devices are described in U.S. Pat. No. 3,380,447 and U.S. Pat. Nos. Des. 267,343 and 4,371,494.

The currently known tilt bed exercise devices represent a rather delicately balanced compromise between stability and manufacturing cost, while trying to achieve a degree of portability. The Martin U.S. Pat. No. 3,707,285 shows a simple structure which is very stable in its floor-to-ceiling mounting, and which has only one pivot at each side of the device. Similarly, the device in U.S. Pat. No. Des. 269,701 is also simple and very stable as a floor supported unit, with also only a single pivot at each side. Other products currently available are typified by the Barber U.S. Pat. No. 4,232,662 in which more than one pivot is provided on each side in order to create a folding base which is more portable.

SUMMARY OF THE INVENTION

This invention provides a full body weight traction device combining the simplicity and stability of the unit shown and described in my co-pending application Ser. No. 376,512 with the ability to be folded into a small package for shipping and portability. In order to achieve that result both the folding function and the pivotal rotation of the bed are performed by a single pivot pin at each side of the device. The front and rear legs are made of single pieces of metal bent into U-shapes, with a stabilizer bar to increase the stability by increasing the footprint on the floor. A trunion that supports the pivoting bed is also U-shaped and uses the same pivot pin that joins the legs at each side. The pivoting bed is comprised of a human torso supporting means and a beam extending therefrom, which is attached to a lockable hinge that may be released and folded for storage or shipment. The torso supporting means is so configured and sized in width as to rotationally pass between the sides of the rear leg U, and to contact and stop in rotation at narrower portions of the sides of the front leg U. The beam extending from the torso supporting means extends between the ankles and terminates in a rail on which a slidably mounted transverse bar is selectably positioned to accomodate various user heights. The transverse bar is adapted to engage hooks which are clamped about the ankles of the user.

The traction device according to the invention is simple and inexpensive to construct, requiring little or no welding and very few parts to be fabricated; but at the same time is extremely stable in use while still being capable of folding for storage or shipping.

DETAILED DESCRIPTION OF THE DRAWINGS

Figure 1:
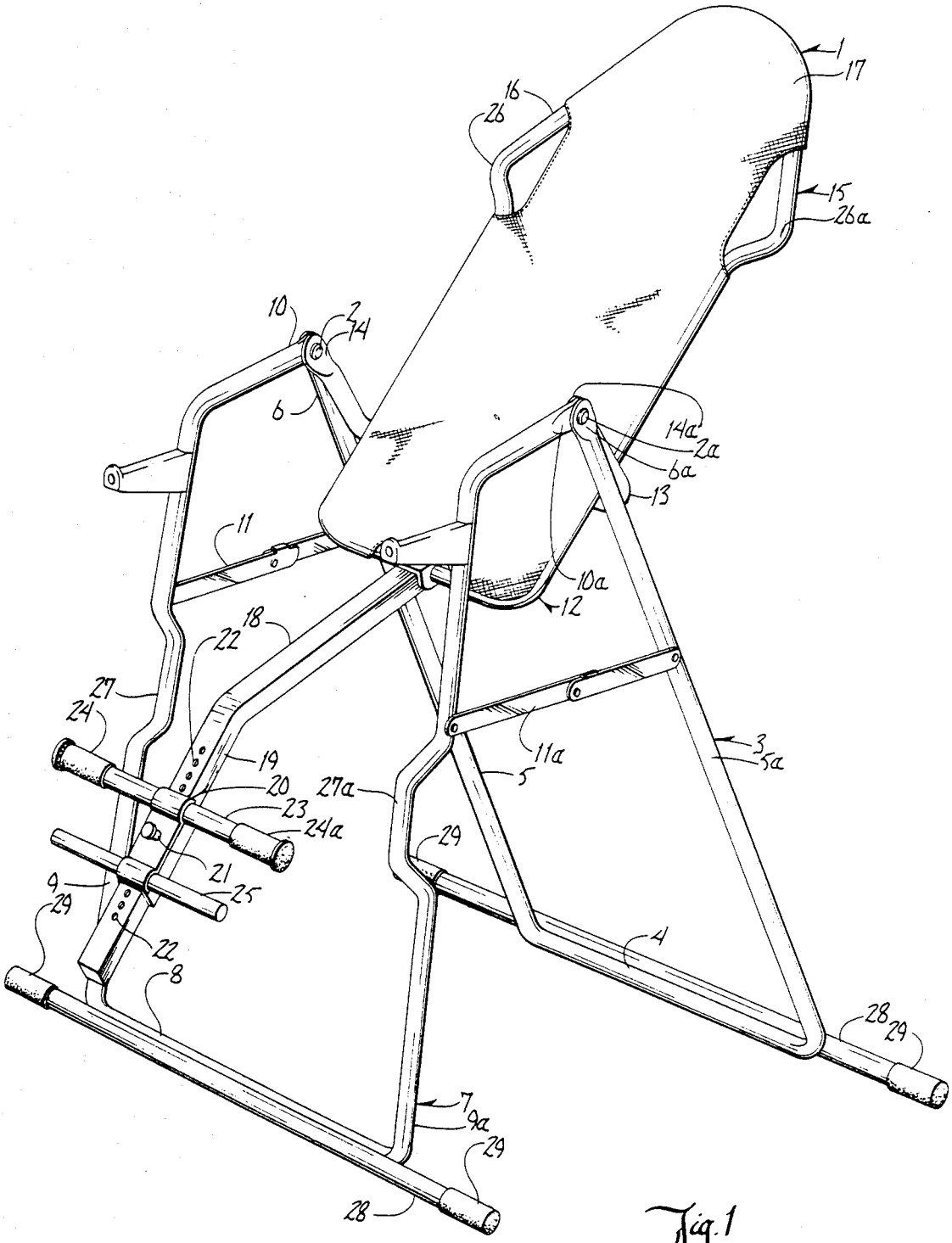
FIG. 1 is a perspective view of the traction device according to the invention.

In FIG. 1 a full body weight traction device 1 is shown having pivot pins 2 and 2*a* supported by a rear leg 3 of generally U-shaped configuration with the base 4 of the U resting on the floor and upstanding sides 5 and 5*a* having pivot bearings 6 and 6*a* at the respective tips, and further supported by front leg 7 also of generally U-shaped configuration with base 8 of the U resting on the floor and upstanding sides 9 and 9*a* having pivot bearings 10 and 10*a* at the respective tips. Pivot bearings 6 and 10 are joined by pivot pin 2 and pivot bearings 6*a* and 10*a* are joined by pivot bearing 2*a*. The base of leg 3 and the base of leg 7 are extendable into an A-frame structural configuration by tension links 11 and 11*a*.

A tilt bed 11 is supported approximately at its mid point by a generally U-shaped trunion bar 13 which is provided with pivot pins 14 and 14*a* in engagement with pivot bearings 2 and 2*a* respectively. A human torso supporting means 15 is provided with a peripheral frame 16 which supports a tension membrane 17. Extending from the lower end of the torso supporting means 15 is a beam 18 terminating at its distal end in a generally straight elongated rail 19. A foot supporting means 20 is slideably attached to the rail 19 in a number of selectable positions by a pin 21 which is engaged in any one of a number of holes 22 in rail 19. The foot supporting means 20 is provided with a rigidly mounted hook bar 28, transverse to the rail 19, terminating in tip guards 24 and 24*a* respectively; and is further provided with a foot rest bar 25.

A portion 26 and 26*a* respectively of peripheral frame 16 is so sized and configured as to be narrower in width than the space between sides 5 and 5*a* of rear leg 3, and wider than the space between narrower portions 27 and 27*a* of front leg 7, whereby the tilt bed 12 may be rotated about pivot bearings 2 and 2*a* with portions 26 and 26*a* of frame 16 passing between the sides of the rear leg 3 but not capable of passing between the sides of the front leg 7.

A stabilizing bar 28 is attached to base portion 8 of front leg 7 to increase the width of its footprint on the floor, and tips 29 are provided at the respective ends of bar 28 to preclude scuffing the floor. Similarly, an additional and optional stabilizing bar 28 is attached to base 4 of rear leg 3 to increase the width of its footprint on the floor, and tips 29 are also provided at the respective ends of bar 28.

Figure 2:
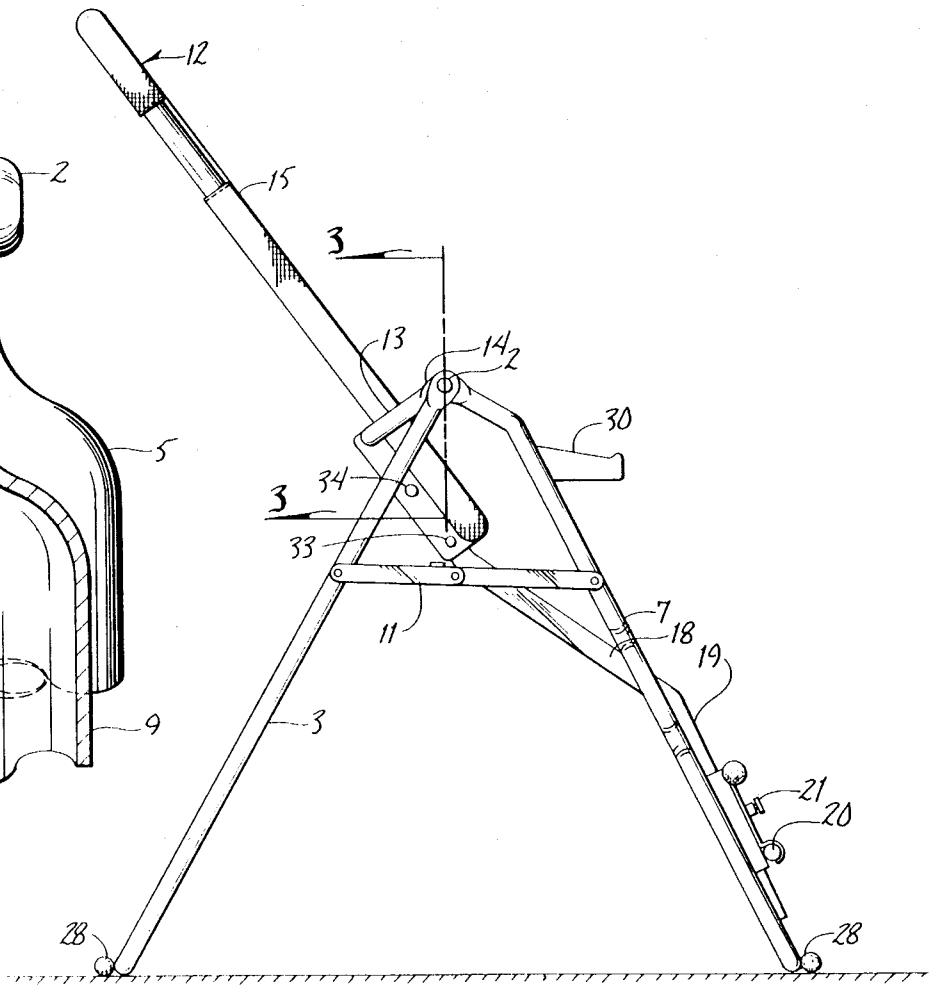
FIG. 2 is a side elevation view of the traction device of FIG. 1.

In FIG. 2 the tilt bed 12 is shown pivotally supported by pivot pin 2, in turn supported by rear leg 3 and front leg 7. The stabilizing bars 28, in addition to providing substantial additional width to the base, also provide additional length to the overall footprint as shown. Beam 18 is shown attached to the torso supporting means 15 by a hinge pin 34 and a releasable latch 33 to permit folding of beam 18 with respect to torso supporting means 15. Tension means 11 is shown as a folding link which is pivotally attached to legs 3 and 7, but may as well be a flexible tension means, such as a cable or chain. A pair of handles 30 may be provided on front leg 7 to assist the user in mounting and dismounting the tilt bed.

Figure 3:
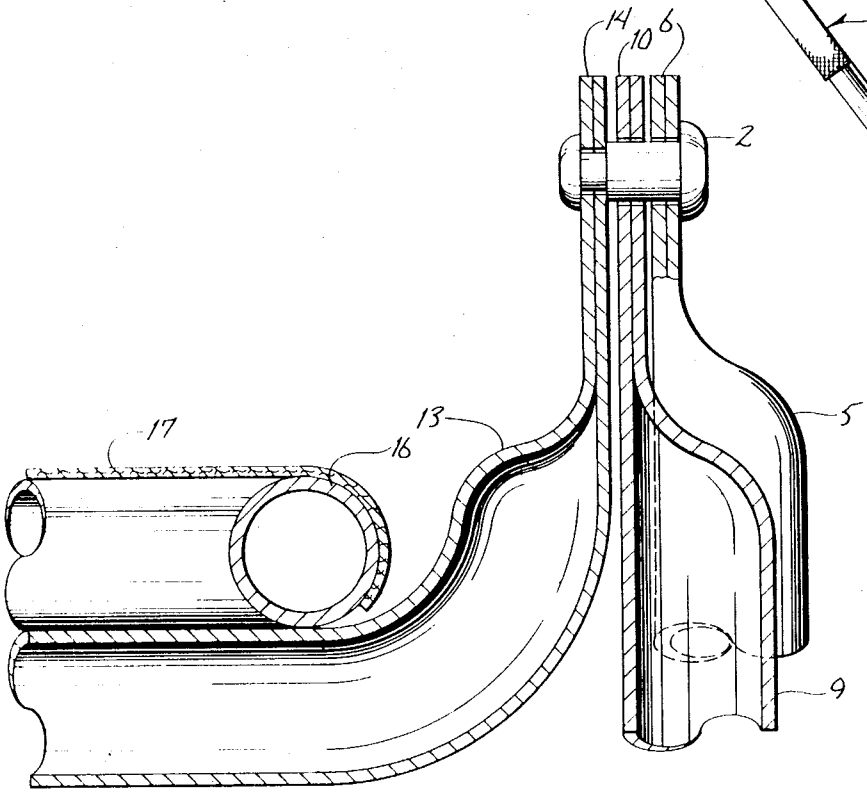
FIG. 3 is a cross sectional view of a pivot pin of the traction device of FIG. 2, taken along line 3—3.

In FIG. 3, which is a cross-sectional view of the pivot pin and associated pivot bearings, shows front leg side 9 having a pivot bearing 10 and rear leg side 5 having a pivot bearing 6 supporting pivot bearing 2, which is in turn supporting pivot pin 14 of trunion 13. Trunion 13 is attached to frame 16 which holds the tension membrane 17 stretched to support the torso of the user. Rotation of the leg sides about pivot bearing 2 permits the legs to fold together for storage, and rotation of the trunion 13 about pivot bearing 2 permits the tilt bed to be rotated into inverted posture.

Figure 4:
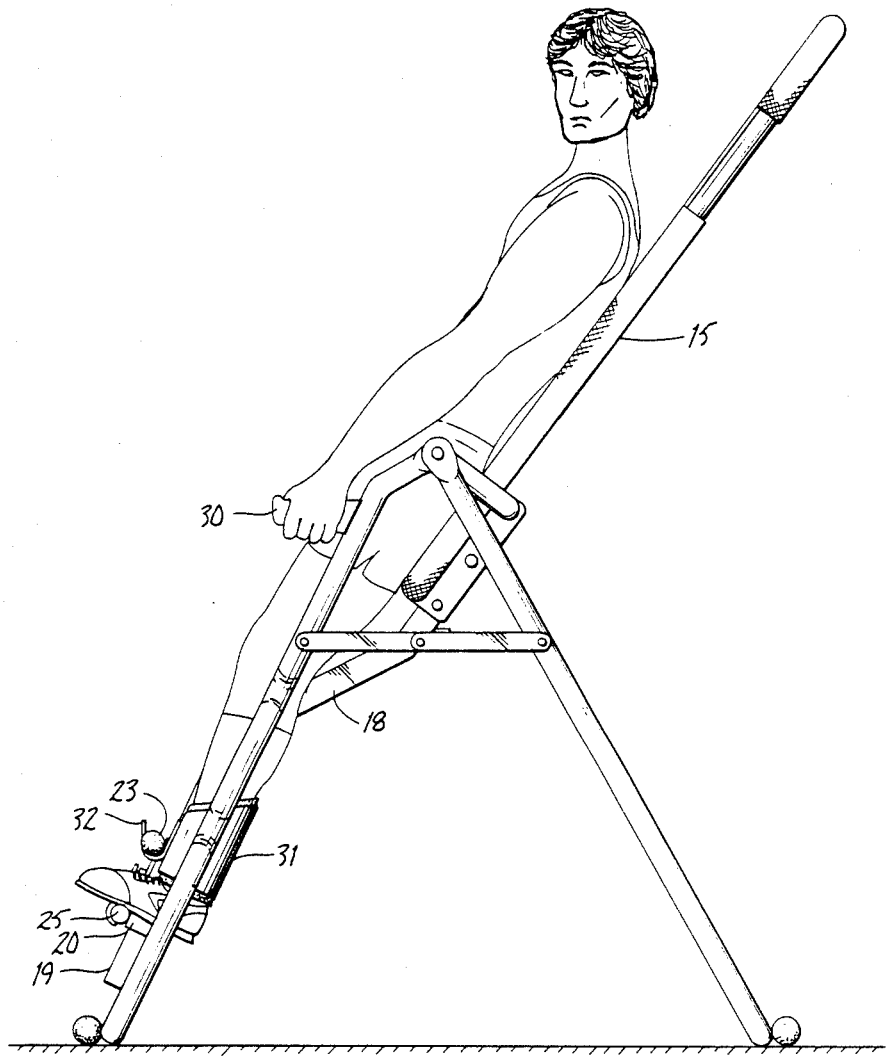
FIG. 4 is a side elevation view of the traction device of FIG. 1 showing a user in upright posture.

FIG. 4 shows a user on tilt bed 12, with his torso resting on the torso supporting means 15 and his hands on the handles 30. A hook 32 is provided on each of a pair of ankle supporting means 31, which are clamped securely about each ankle of the user with hooks 32, secured on hook bar 23 and the user's feet resting on foot bar 25 of the foot supporting means 20.

Figure 5:
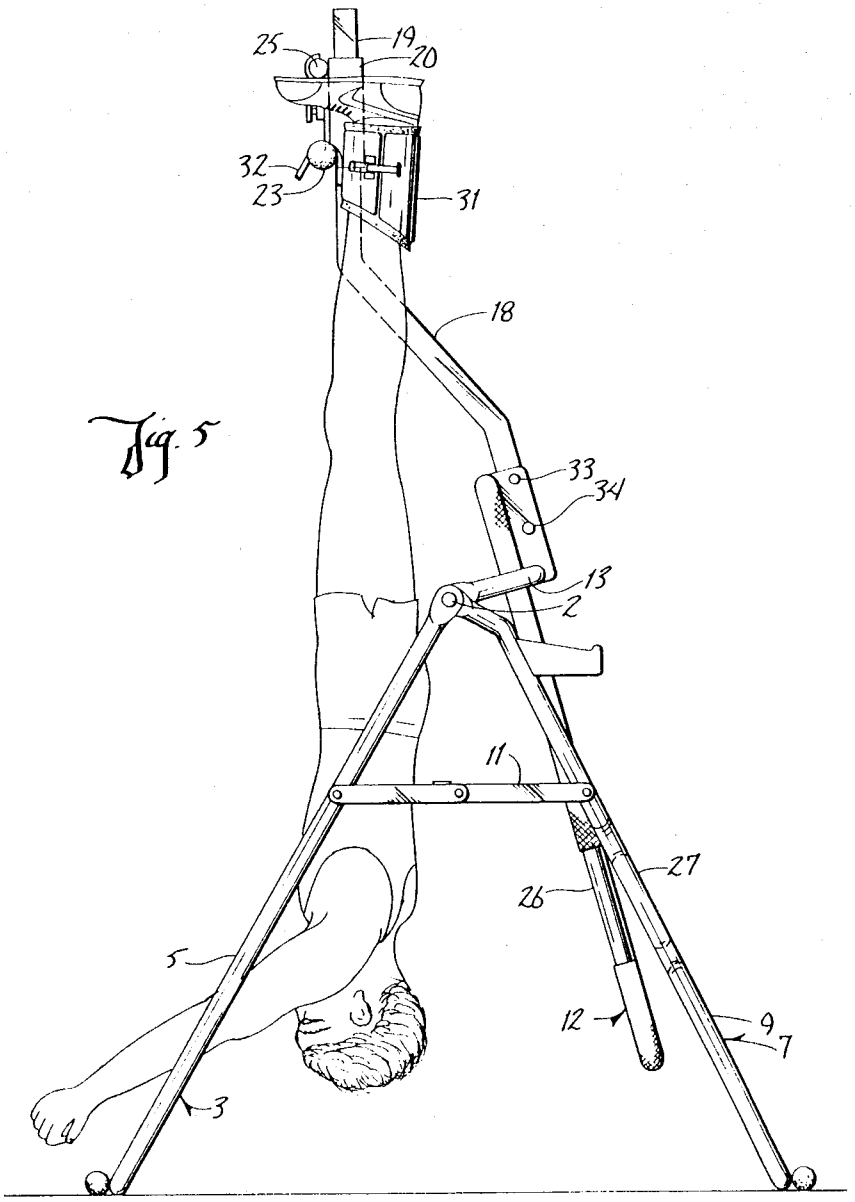
FIG. 5 is a side elevation view of the traction device of FIG. 1 showing a user in inverted posture.

In FIG. 5 the user may be seen in inverted posture, having extended his arms as shown to produce an overturning moment sufficient to rotate the tilt bed 12 and the user into inversion. The hooks 37 of the ankle supporting means 31 are engaged with the hook bar 23 of the foot supporting means 20, wherein the user's weight is supported from the hook bar 23, and the user's feet are no longer supported by the foot rest bar 25. Since the user's center of gravity has passed across the pivot pin 2 which supports trunion 13, the user remains stable in the inverted posture at the rotational position where portion 26 of peripheral frame 16 has passed side 5 of rear leg 3 and rests against narrowed portion 27 of side 9 of front leg 7.

Figure 6:
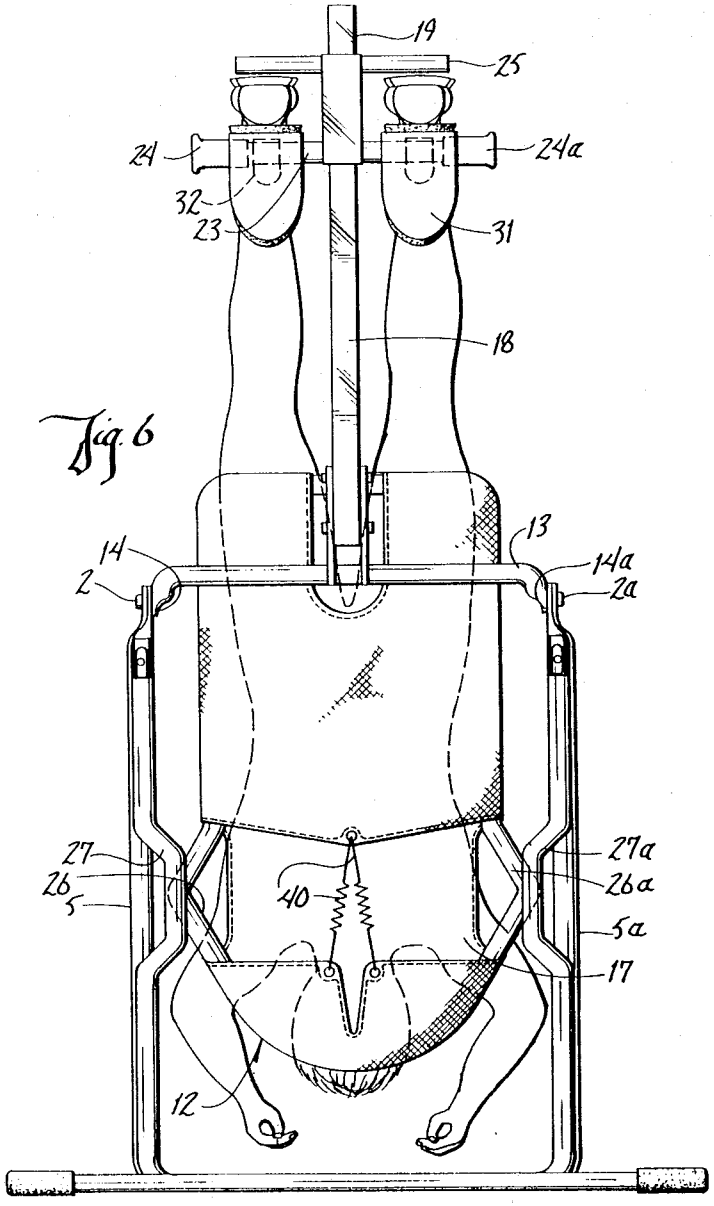
FIG. 6 is a front elevation view of the traction device of FIG. 1 showing a user in inverted posture.

FIG. 6 more clearly shows the user in inverted posture on tilt bed 12, with portions 26 and **26*a* having passed between rear leg sides 5 and 5*a* to rest against narrowed portions 27 and 27*a* of front leg sides 9 and 9*a* respectively. Hooks 32 on the ankle supporting means 31 are engaged on hook bar 23 to support the user's weight. Tip guards 24 and 24*a* are attached to the ends of hook bar 23 to prevent the user from inadvertently sliding the hooks off the end of hook bar 23 while inverted. The back of tension membrane 17 is shown wrapped around peripheral frame 17 and secured under tension by resilient members 40**.

Figure 7:
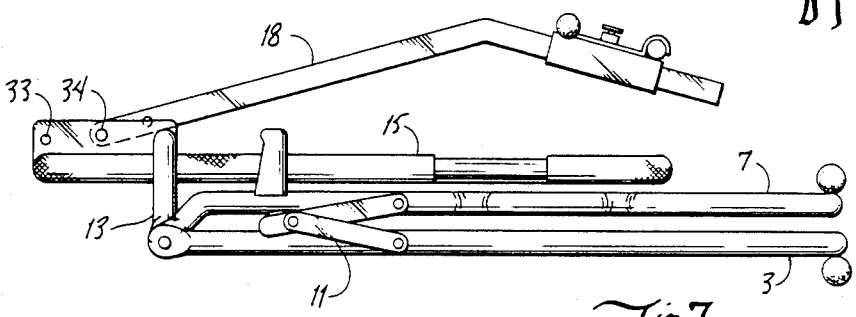
FIG. 7 is a side elevation view of the traction device of FIG. 1 shown in the folded configuration for storage or shipment.

In FIG. 7 the traction device man be seen in a folded configuration for shipment or storage. Tension link 11 has been collapsed to permit the rear leg 3 to fold against front leg 7. Trunion 13 has been rotated so that the torso supporting means 15 is against front leg 7. Latch 33 has been released, which permits beam 19 to hinge about hinge pin 34 and fold against the torso supporting means 15, whereby the traction device is folded into a relatively compact configuration.

The full body weight traction device shown and described above represents an extremely stable structure that is capable of folding, which is manufacturable at a low cost. It is characterized by the use of fewer parts to perform the essential functions than prior art devices.

I claim:

1. A full body weight traction device for rotating a human into inverted posture comprising a pair of spaced apart pivot pins;

means for supporting said pivot pin in a coaxial relationship parallel to and spaced above a floor surface, said means including a generally U-shaped rear leg wherein the base of the U rests on the floor and the sides of the U are upstanding and have pivot pin bearings in the respective tips, and said means further including a generally U-shaped front leg wherein the base of the U rest on the floor and the sides of the U are generally upstanding with portions thereof being spaced closer together than the sides of the rear leg, the sides also having pivot pin bearings in the respective tips, the pivot pin bearings of each respective side of the front and rear legs being joined by one of the pivot pins, and the lower portions of the front and rear legs being held in a spaced relationship by tension means;

a tilt bed disposed between said pivot pins and pivotally mounted therein at its approximate mid-point by a generally U-shaped trunion wherein the tilt bed rests on and is attached to the base of the U and the legs of the U are generally upstanding and have pivot pin bearings in the respective tips, the pivot pin bearings being further joined by the respective pivot pins joining the respective sides of the front and rear legs;

a human torso supporting means on said tilt bed so sized and configured generally to match to the size of a human torso;

a beam extending from the lower end of said torso supporting means and terminating in an elongated rail disposed between the ankles of a human user;

a foot supporting means slidably attached to said rail with selectable fixed locations along the rail; and a portion of the torso supporting means on each side which is configured to be narrower in width than the spacing between the rear leg sides and wider than the spacing between the front leg sides, whereby the tilt bed is free to rotate on its bearings through the rear leg space to be stopped in the inverted position by the front leg sides.

2. A traction device according to claim 1 in which the beam extending from the lower end of the torso supporting means is provided with a hinge and locking means at its point of attachment to the torso supporting means.

3. A traction device according to claim 1 in which the torso supporting means comprises a rigid peripheral frame supporting a textile membrane.

4. A traction device according to claim 1 in which the base of at least one of the U-shaped legs is provided with a stabilizer means which widens the footprint of its contact with the floor.

5. A traction device according to claim 1 in which the upstanding sides of the front leg are provided with handgrips to assist the user in mounting and dismounting the tilt bed.

6. A traction device according to claim 1 in which the front and rear legs are provided with a tension connection therebetween which limits the distance between the extension of the front and rear legs.

7. A traction device according to claim 1 in which the foot supporting means includes a horizontal bar on which a hook is engaged on each side of the rail, said hook being fixed to an ankle supporting means clamped about each ankle of the user.

8. A traction device according to claim 2 in which the lengths of the sides of the legs are approximatey equal, the length of the torso supporting means is no greater than the length of said legs, and the length of the beam is no greater than the length of the legs; whereby the device may be folded into a generally flat configuration approximately the length of the legs without component dissembly.

9. An exercise device comprising, a pair of spaced apart pivot bearings, a frame for supporting said pivot bearings in a coaxial relationship parallel to and spaced above a floor surface, said frame having two anterior legs and two posterior legs wherein portions of the anterior legs are spaced closer than the posterior legs, a tilt bed disposed between said pivot bearings and pivotally mounted therein at its approximate midpoint;

a beam extending from the lower end of said tilt bed terminating in an elongated rail adapted to be disposed between the ankles of a user;

a foot supporting means attached to said rail; and said tilt bed including outwardly extending portions on each side being configured to provide a bed width which is narrower in width than the spacing between the posterior legs and wider than the spacing between the portions on said anterior legs whereby the tilt bed is free to rotate on its bearings through the posterior leg space to be stopped in the inverted position by the portions on the anterior legs engaging the portions on said tilt bed.

* * * * *